US007147059B2

(12) United States Patent
Hirsch et al.

(10) Patent No.: US 7,147,059 B2
(45) Date of Patent: Dec. 12, 2006

(54) USE OF DOWNHOLE HIGH PRESSURE GAS IN A GAS-LIFT WELL AND ASSOCIATED METHODS

(75) Inventors: John M. Hirsch, Houston, TX (US); George Leo Stegemeier, Houston, TX (US); James William Hall, Katy, TX (US); Harold J. Vinegar, Houston, TX (US); Robert Rex Burnett, Katy, TX (US); William Mountjoy Savage, Houston, TX (US); Frederick Gordon Carl, Jr., Houston, TX (US)

(73) Assignee: Shell Oil Company, Houston, TX (US)

( * ) Notice: Subject to any disclaimer, the term of this patent is extended or adjusted under 35 U.S.C. 154(b) by 462 days.

(21) Appl. No.: 10/220,249

(22) PCT Filed: Mar. 2, 2001

(86) PCT No.: PCT/US01/06986

§ 371 (c)(1),
(2), (4) Date: Aug. 29, 2002

(87) PCT Pub. No.: WO01/65062

PCT Pub. Date: Sep. 7, 2001

(65) Prior Publication Data

US 2003/0024704 A1 Feb. 6, 2003

Related U.S. Application Data

(60) Provisional application No. 60/186,382, filed on Mar. 2, 2000.

(51) Int. Cl.
*E21B 43/12* (2006.01)
*E21B 43/14* (2006.01)
*E21B 43/00* (2006.01)

(52) U.S. Cl. ..... 166/372; 166/373; 166/66.6; 166/133; 166/188

(58) Field of Classification Search ..... 166/372, 166/373, 386, 387, 250.15, 66.6, 133, 146, 166/147, 188
See application file for complete search history.

(56) References Cited

U.S. PATENT DOCUMENTS

| | | | | |
|---|---|---|---|---|
| 525,663 | A | | 9/1894 | Mottinger |
| 2,917,004 | A | | 12/1959 | Davis et al. |
| 3,083,771 | A | | 4/1963 | Chapman |
| 3,087,545 | A | * | 4/1963 | O'Brien ..... 166/302 |
| 3,247,904 | A | | 4/1966 | Wakefield |
| 3,427,989 | A | | 2/1969 | Bostock et al. ..... 103/232 |
| 3,566,963 | A | | 3/1971 | Blackledge |
| 3,602,305 | A | | 8/1971 | Kisling, III |
| 3,732,728 | A | | 5/1973 | Fitzpatrick ..... 73/151 |
| 3,793,632 | A | | 2/1974 | Still ..... 340/18 |
| 3,814,545 | A | | 6/1974 | Waters |
| 3,837,618 | A | | 9/1974 | Juhel ..... 251/129 |
| 3,980,826 | A | | 9/1976 | Widmer ..... 178/68 |
| 4,068,717 | A | | 1/1978 | Needham ..... 166/272 |
| 4,087,781 | A | | 5/1978 | Grossi et al. ..... 340/18 |
| 4,295,795 | A | | 10/1981 | Gass et al. ..... 417/111 |
| 4,350,205 | A | * | 9/1982 | Goldschild et al. ..... 166/375 |
| 4,393,485 | A | | 7/1983 | Redden ..... 367/25 |
| 4,468,665 | A | | 8/1984 | Thawley et al. ..... 340/856 |
| 4,545,731 | A | | 10/1985 | Canalizo et al. |
| 4,576,231 | A | | 3/1986 | Dowling et al. ..... 166/248 |
| 4,578,675 | A | | 3/1986 | MacLeod ..... 340/855 |
| 4,596,516 | A | | 6/1986 | Scott et al. ..... 417/58 |
| 4,630,243 | A | | 12/1986 | MacLeod ..... 367/82 |
| 4,648,471 | A | | 3/1987 | Bordon ..... 175/4.55 |
| 4,662,437 | A | | 5/1987 | Renfro ..... 166/65.1 |
| 4,681,164 | A | | 7/1987 | Stacks ..... 166/304 |
| 4,709,234 | A | | 11/1987 | Forehand et al. ..... 340/856 |
| 4,738,313 | A | | 4/1988 | McKee ..... 166/372 |
| 4,739,325 | A | | 4/1988 | MacLeod ..... 340/854 |
| 4,790,375 | A | * | 12/1988 | Bridges et al. ..... 166/60 |
| 4,839,644 | A | | 6/1989 | Safinya et al. ..... 340/854 |
| 4,886,114 | A | | 12/1989 | Perkins et al. ..... 166/65.1 |
| 4,901,069 | A | | 2/1990 | Veneruso ..... 340/853 |
| 4,972,704 | A | | 11/1990 | Wellington et al. ..... 73/155 |
| 4,981,173 | A | | 1/1991 | Perkins et al. ..... 166/66.4 |
| 5,001,675 | A | | 3/1991 | Woodward ..... 367/13 |
| 5,008,664 | A | | 4/1991 | More et al. ..... 340/854 |

| | | | | |
|---|---|---|---|---|
| 5,031,697 | A * | 7/1991 | Wellington et al. | 166/250.12 |
| 5,130,706 | A | 7/1992 | Van Steenwyk | 340/854.6 |
| 5,134,285 | A | 7/1992 | Perry et al. | 250/269 |
| 5,160,925 | A | 11/1992 | Dailey et al. | 340/853.3 |
| 5,162,740 | A | 11/1992 | Jewell | 324/347 |
| 5,172,717 | A | 12/1992 | Boyle et al. | 137/155 |
| 5,176,164 | A | 1/1993 | Boyle | 137/155 |
| 5,191,326 | A | 3/1993 | Montgomery | 340/855.5 |
| 5,230,383 | A | 7/1993 | Pringle | |
| 5,246,860 | A | 9/1993 | Hutchins et al. | 436/27 |
| 5,251,328 | A | 10/1993 | Shaw | 455/73 |
| 5,257,663 | A * | 11/1993 | Pringle et al. | 166/66.4 |
| 5,267,469 | A | 12/1993 | Espinoza | 73/40.5 |
| 5,278,758 | A | 1/1994 | Perry et al. | 364/422 |
| 5,291,947 | A * | 3/1994 | Stracke | 166/187 |
| 5,331,318 | A | 7/1994 | Montgomery | 340/855.4 |
| 5,353,627 | A | 10/1994 | Diatschenko et al. | 73/19.03 |
| 5,358,035 | A | 10/1994 | Grudzinski | 166/53 |
| 5,367,694 | A | 11/1994 | Ueno | 395/800 |
| 5,394,141 | A | 2/1995 | Soulier | 340/854.4 |
| 5,396,232 | A | 3/1995 | Mathieu et al. | 340/854.5 |
| 5,425,425 | A | 6/1995 | Bankston et al. | 166/377 |
| 5,447,201 | A | 9/1995 | Mohn | 166/375 |
| 5,458,200 | A | 10/1995 | Lagerlef et al. | 166/372 |
| 5,467,083 | A | 11/1995 | McDonald et al. | 340/854.6 |
| 5,473,321 | A | 12/1995 | Goodman et al. | 340/854.9 |
| 5,493,288 | A | 2/1996 | Henneuse | 340/854.4 |
| 5,531,270 | A | 7/1996 | Fletcher et al. | 166/53 |
| 5,561,245 | A | 10/1996 | Georgi et al. | 73/152.02 |
| 5,574,374 | A | 11/1996 | Thompson et al. | 324/338 |
| 5,576,703 | A | 11/1996 | MacLeod et al. | 340/854.4 |
| 5,587,707 | A | 12/1996 | Dickie et al. | 340/870.09 |
| 5,592,438 | A | 1/1997 | Rorden et al. | 367/83 |
| 5,662,165 | A | 9/1997 | Tubel et al. | 166/250.01 |
| 5,723,781 | A | 3/1998 | Pruett et al. | 73/152.18 |
| 5,730,219 | A | 3/1998 | Tubel et al. | 66/250.01 |
| 5,745,047 | A * | 4/1998 | Van Gisbergen et al. | 340/853.1 |
| 5,782,261 | A | 7/1998 | Becker et al. | 137/155 |
| 5,797,453 | A | 8/1998 | Hisaw | 166/117.5 |
| 5,881,807 | A | 3/1999 | Boe et al. | 166/100 |
| 5,883,516 | A | 3/1999 | Van Steenwyk et al. | 324/366 |
| 5,887,657 | A | 3/1999 | Bussear et al. | 166/336 |
| 5,896,924 | A | 4/1999 | Carmody et al. | 166/53 |
| 5,934,371 | A | 8/1999 | Bussear et al. | 166/53 |
| 5,937,945 | A | 8/1999 | Bussear et al. | 166/250.15 |
| 5,941,307 | A | 8/1999 | Tubel | 166/313 |
| 5,955,666 | A | 9/1999 | Mullins | 73/152.18 |
| 5,959,499 | A | 9/1999 | Khan et al. | 330/149 |
| 5,960,883 | A | 10/1999 | Tubel et al. | 166/313 |
| 5,963,090 | A | 10/1999 | Fukuchi | 330/149 |
| 5,971,072 | A | 10/1999 | Huber et al. | 166/297 |
| 5,975,204 | A | 11/1999 | Tubel et al. | |
| 5,995,020 | A | 11/1999 | Owens et al. | 340/854.9 |
| 6,012,015 | A | 1/2000 | Tubel | 702/6 |
| 6,012,016 | A | 1/2000 | Bilden et al. | 702/12 |
| 6,070,608 | A | 6/2000 | Pringle | 137/155 |
| 6,089,322 | A * | 7/2000 | Kelley et al. | 166/370 |
| 6,123,148 | A | 9/2000 | Oneal | |
| 6,148,915 | A | 11/2000 | Mullen | |
| 6,192,983 | B1 | 2/2001 | Neuroth et al. | 166/250.15 |
| 6,208,586 | B1 | 3/2001 | Rorden et al. | 367/35 |
| 6,334,486 | B1 | 1/2002 | Carmody et al. | 166/53 |
| 6,352,109 | B1 * | 3/2002 | Buckman, Sr. | 166/250.03 |
| 6,464,004 | B1 * | 10/2002 | Crawford et al. | 166/250.01 |
| 6,484,800 | B1 | 11/2002 | Carmody et al. | 166/53 |
| 6,662,875 | B1 * | 12/2003 | Bass et al. | 166/369 |
| 2003/0056952 | A1 * | 3/2003 | Stegemeier et al. | 166/250.12 |

FOREIGN PATENT DOCUMENTS

| | | | |
|---|---|---|---|
| EP | 28296 | | 5/1981 |
| EP | 295178 | A2 | 12/1988 |
| EP | 339825 | A1 | 4/1989 |
| EP | 492856 | A2 | 7/1992 |
| EP | 641916 | | 3/1995 |
| EP | 681090 | A2 | 11/1995 |
| EP | 697500 | A2 | 2/1996 |
| EP | 0 721 053 | A1 | 7/1996 |
| EP | 732053 | | 9/1996 |
| EP | 919696 | A2 | 6/1999 |
| EP | 922835 | A2 | 6/1999 |
| EP | 930518 | A2 | 7/1999 |
| EP | 964134 | A2 | 12/1999 |
| EP | 972909 | A2 | 1/2000 |
| EP | 999341 | A2 | 5/2000 |
| FR | 2677134 | | 12/1992 |
| GB | 2083321 | A | 3/1982 |
| GB | 2 327 695 | A | 2/1999 |
| GB | 2325949 | A | 2/1999 |
| GB | 2338253 | A | 12/1999 |
| RU | 2129208 | | 4/1999 |
| WO | 80/00727 | | 4/1980 |
| WO | 93/26115 | | 12/1993 |
| WO | 96/00836 | | 1/1996 |
| WO | 96/24747 | | 8/1996 |
| WO | 97/16751 | | 5/1997 |
| WO | 97 37103 | | 10/1997 |
| WO | 98/20233 | | 5/1998 |
| WO | 99/37044 | | 7/1999 |
| WO | 99/57417 | | 11/1999 |
| WO | 99/60247 | | 11/1999 |
| WO | 00/04275 | | 1/2000 |
| WO | 00/37770 | | 6/2000 |
| WO | 01/20126 | A2 | 3/2001 |
| WO | 01/55555 | A1 | 8/2001 |

OTHER PUBLICATIONS

Brown, Connolizo and Robertson, West Texas Oil Lifting Short Course and H.W. Winkler, "Misunderstood or overlooked Gas-Lift Design and Equipment Considerations," SPE, pp. 351-368 (1994).

Der Spek, Alex, and Aliz Thomas, "Neural-Net Identification of Flow Regime with Band Spectra of Flow-Generated Sound", SPE Reservoir Eva. & Eng.2 (6) Dec. 1999, pp. 489-498.

Sakata et al., "Performance Analysis of Long Distance Transmitting of Magnetic Signal on Cylindrical Steel Rod", IEEE Translation Journal on magnetics in Japan, vol. 8, No. 2. Feb. 1993, pp. 102-106.

Office Action dated Oct. 24, 2003, U.S. Appl. No. 09/768,705, Vinegar.

Office Action dated Feb. 21, 2003, U.S. Appl. No. 09/768,705, Vinegar.

Office Action dated Feb. 28, 2002, U.S. Appl. No. 09/768,705, Vinegar.

Office Action dated May, 18, 2004, U.S. Appl. No. 10/220,455, Hirsch.

Office Action dated Nov. 19, 2003, U.S. Appl. No. 10/220,455, Hirsch.

* cited by examiner

*Primary Examiner*—David Bagnell
*Assistant Examiner*—Shane Bomar
(74) *Attorney, Agent, or Firm*—Rachael Stiegel

(57) ABSTRACT

A gas-lift petroleum well and method for producing petroleum products using downhole pressurized gas to provide lift. The gas-lift well having a well casing, a production tubing, a packer, and a gas-lift valve. The well casing extends within a wellbore of the well, and the wellbore extends through oil and gas zones. The production tubing extends within the casing. The tubing having an opening formed therein, which is in fluid communication with an oil zone. The packer is located downhole in the casing and coupled to the tubing. The packer can have an electrically controllable packer valve, which is adapted to control a flow of downhole pressurized gas from one side of the packer to another. The downhole pressurized gas is provided by a gas zone that the wellbore passes through. The downhole gas-lift valve is coupled to the tubing and is adapted to control a flow of downhole pressurized gas into oil in the tubing for lifting the oil. The gas-lift valve can be an electrically controllable valve. The tubing and casing are used as electrical conductors for supplying power and/or communications downhole. The current in the tubing is routed using a ferromagnetic induction choke to create a voltage potential, which provides electrical power to downhole electrical devices. Also, there may be a bypass passageway to route downhole gas to gas-lift valves. There may also be downhole sensors to measure physical quantities (e.g., pressure). Such measurements can be used for feedback control of downhole electrically controllable valves.

13 Claims, 4 Drawing Sheets

FIG. 1
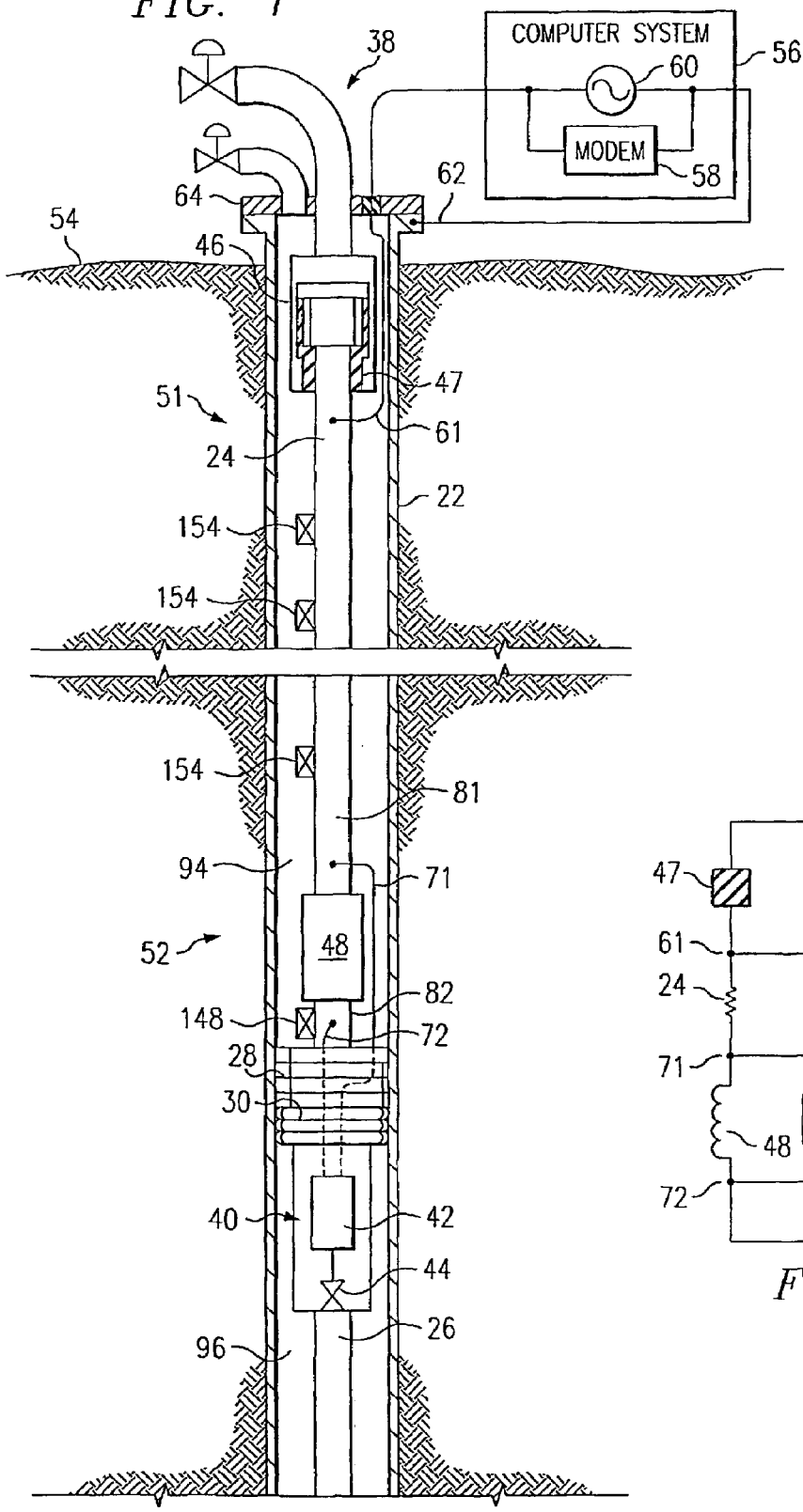
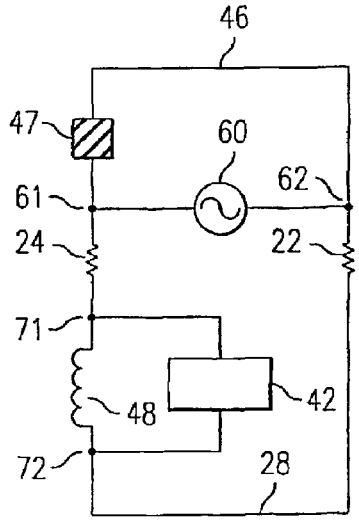
FIG. 2

USE OF DOWNHOLE HIGH PRESSURE GAS IN A GAS-LIFT WELL AND ASSOCIATED METHODS

CROSS-REFERENCES TO RELATED APPLICATIONS

This application claims the benefit of the following U.S. Provisional Applications, all of which are hereby incorporated by reference:

COMMONLY OWNED AND PREVIOUSLY FILED U.S. PROVISIONAL Pat. applications

| T&K # | Ser. No. | Title | Filing Date |
|---|---|---|---|
| TH 1599 | 60/177,999 | Toroidal Choke Inductor for Wireless Communication and Control | Jan. 24, 2000 |
| TH 1600 | 60/178,000 | Ferromagnetic Choke in Wellhead | Jan. 24, 2000 |
| TH 1602 | 60/178,001 | Controllable Gas-Lift Well and Valve | Jan. 24,2000 |
| TH 1603 | 60/177,883 | Permanent, Downhole, Wireless, Two-Way Telemetry Backbone Using Redundant Repeater, Spread Spectrum Arrays | Jan. 24,2000 |
| TH 1668 | 60/177,998 | Petroleum Well Having Downhole Sensors, Communication, and Power | Jan. 24, 2000 |
| TH 1669 | 60/177,997 | System and Method for Fluid Flow Optimization | Jan. 24, 2000 |
| TS 6185 | 60/181,322 | A Method and Apparatus for the Optimal Predistortion of an Electromagnetic Signal in a Downhole Communications System | Feb. 9, 2000 |
| TH 1599x | 60/186,376 | Toroidal Choke Inductor for Wireless Communication and Control | Mar. 2, 2000 |
| TH 1600x | 60/186,380 | Ferromagnetic Choke in Wellhead | Mar. 2, 2000 |
| TH 1601 | 60/186,505 | Reservoir Production Control from Intelligent Well Data | Mar. 2, 2000 |
| TH 1671 | 60/186,504 | Tracer Injection in a Production Well | Mar. 2, 2000 |
| TH 1672 | 60/186,379 | Oilwell Casing Electrical Power Pick-Off Points | Mar. 2, 2000 |
| TH 1673 | 60/186,375 | Controllable Production Well Packer | Mar. 2, 2000 |
| TH 1674 | 60/186,382 | Use of Downhole High Pressure Gas in a Gas Lift Well | Mar. 2, 2000 |
| TH 1675 | 60/186,503 | Wireless Smart Well Casing | Mar. 2, 2000 |
| TH 1677 | 60/186,527 | Method for Downhole Power Management Using Energization from Distributed Batteries or Capacitors with Reconfigurable Discharge | Mar. 2, 2000 |
| TH 1679 | 60/186,393 | Wireless Downhole Well Interval Inflow and Injection Control | Mar. 2, 2000 |
| TH 1681 | 60/186,394 | Focused Through-Casing Resistivity Measurement | Mar. 2, 2000 |
| TH 1704 | 60/186,531 | Downhole Rotary Hydraulic Pressure for Valve Actuation | Mar. 2, 2000 |
| TH 1705 | 60/186,377 | Wireless Downhole Measurement and Control For Optimizing Gas Lift Well and Field Performance | Mar. 2, 2000 |
| TH 1722 | 60/186,381 | Controlled Downhole Chemical Injection | Mar. 2, 2000 |
| TH 1723 | 60/186,378 | Wireless Power and Communications Cross-Bar Switch | Mar. 2, 2000 |

The current application shares some specification and figures with the following commonly owned and concurrently filed applications, all of which are hereby incorporated by reference:

COMMONLY OWNED AND CONCURRENTLY FILED U.S Pat. applications

| T&K # | Ser. No. | Title | Filing Date |
|---|---|---|---|
| TH 1601US | 10/220,254 | Reservoir Production Control from Intelligent Well Data | Aug. 29, 2002 |
| TH 1671US | 10/220,251 | Tracer Injection in a Production Well | Aug. 29, 2002 |
| TH 1673US | 10/220,252 | Controllable Production Well Packer | Aug. 29, 2002 |
| TH 1672US | 10/220,402 | OILWELL CASING ELECTRICAL POWER PICK-OFF POINTS | Aug. 29, 2002 |
| TH 1675US | 10/220,195 | Wireless Smart Well Casing | Aug. 29, 2002 |
| TH 1677US | 10/220,253 | Method for Downhole Power Management Using Energization from Distributed Batteries or Capacitors with Reconfigurable Discharge | Aug. 29, 2002 |
| TH 1679US | 10/220,453 | Wireless Downhole Well Interval Inflow and Injection Control | Aug. 29, 2002 |
| TH 1704US | 10/220,326 | Downhole Rotary Hydraulic Pressure for Valve Actuation | Aug. 29, 2002 |
| TH 1705US | 10/220,455 | Wireless Downhole Measurement and Control For Optimizing Gas Lift Well and Field Performance | Aug. 29, 2002 |
| TH 1722US | 10/220,372 | Controlled Downhole Chemical Injection | Aug. 29, 2002 |
| TH 1723US | 10/220,652 | Wireless Power and Communications Cross-Bar Switch | Aug. 29, 2002 |

The current application shares some specification and figures with the following commonly owned and previously filed applications, all of which are hereby incorporated by reference:

COMMONLY OWNED AND PREVIOUSLY FILED U.S Pat. applications

| | Ser. No. | Title | Filing Date |
|---|---|---|---|
| TH 1599US | 09/769,047 | Toroidal Choke Inductor for Wireless Communication and Control | Oct. 20, 2003 |
| TH 1600US | 09/769,048 | Induction Choke for Power Distribution in Piping Structure | Jan. 24, 2001 |
| TH 1602US | 09/768,705 | Controllable Gas-Lift Well and Valve | Jan. 24, 2001 |
| TH 1603US | 09/768,655 | Permanent Downhole, Wireless, Two-Way Telemetry Backbone Using Redundant Repeater | Jan. 24, 2001 |
| TH 1668US | 09/768,046 | Petroleum Well Having Downhole Sensors, Communication, and Power | Jan. 24, 2001 |
| TH 1669US | 09/768,656 | System and Method for Fluid Flow Optimization | Jan. 24, 2001 |

-continued

| COMMONLY OWNED AND PREVIOUSLY FILED U.S Pat. applications | | | |
|---|---|---|---|
| | Ser. No. | Title | Filing Date |
| TS 6185US | 09/779,935 | A Method and Apparatus for the Optimal Predistortion of an Electro Magnetic Signal In a Downhole Communication System | Feb. 8, 2001 |

The benefit of 35 U.S.C. § 120 is claimed for all of the above referenced commonly owned applications. The applications referenced in the tables above are referred to herein as the "Related Applications."

BACKGROUND OF THE INVENTION

1. Field of the Invention

The present invention relates to a gas-lift petroleum well for producing reservoir fluids which uses reservoir gas for production. In one aspect, the present invention relates to a system and method of using an electronically controllable downhole valve and downhole pressurized gas to lift fluids up a well for petroleum production purposes.

2. Description of the Related Art

Gas lift is widely used to generate artificial lift in oil wells having insufficient reservoir pressure to drive formation fluids to the surface. In current practice lift gas is supplied to the well by surface compressors connected through an injection control valve to an annular space formed between a production tubing and a well casing. The gas flows down the annular space to a downhole gas-lift valve, which fluidly connects the annular space to the interior of the tubing. The gas-lift valve may be located just above the oil production zone, and the lift is generated by the combination of reduced density in the fluid column filling the tubing caused by gas bubbles from the gas-lift valve, and by entrained flow of the fluids by the rising gas stream in the tubing.

A variety of flow regimes in the tubing are recognized, and are determined by the gas flow rate at the gas-lift valve. The gas bubbles in the tubing decompress as they rise in the tubing because the head pressure of the fluid column above drops as the bubbles rise. This decompression causes the bubbles to expand, so that the flow regimes within the tubing can vary up the tubing, depending on the volumetric ratio of bubbles to liquid. Other factors contribute to determining the flow regime, such as fluid column height, fluid composition and phases present, tubing diameter, depth of well, temperature, back pressure set by the production control valve, and physical characteristics of the surface collection system. For the effective use of gas lift, it is important to control the injection rate of the lift gas.

Conventionally, the injection rate at the gas-lift valve is determined by the pressure difference across the valve, and its orifice size. In existing practice, the pressure on the annulus side is determined by the gas supply flow rate at the surface connection. On the tubing interior side of the gas-lift valve the pressure is determined by a number of factors, notably the static head of the fluid column above the valve, the flow rate of fluids up the tubing, the formation pressure, and the inflow rate in the oil production zone. Typically the orifice size of the gas lift valve is preset by selection at the time the valve is installed, and cannot be changed thereafter without changing the valve, which requires that the well be taken out of production.

The ongoing supply of compressed lift gas is a major determinant of production cost. The cost is a combination of the capital investment to provide the compressors and field infrastructure to convey the gas to each well, and the ongoing operating cost of running the compressors and maintaining them.

Many oil reservoirs have high-pressure gas caps or underlying high-pressure gas zones separated from the oil-bearing zones by impermeable layers. Nevertheless, in most situations the naturally-occurring reservoir gas is not used to lift the oil because of the inability to devise a method to monitor and control downhole operations. Attempts have been made to use reservoir gas for lift, see, e.g. U.S. Pat. Nos. 3,814,545 and 4,545,731, and Otis Engineering publication dated August 1980 entitled "Heavy Crude Lift Systems." (Field Development Report OEC 5228, Otis Corporation, Dallas, Tex., 1980.) Instead, where it is necessary to provide a lift to the oil, a gas-lift well is used with compressed gas generated at the surface and forced downhole to lift the oil from the oil production zones. Hence, there is a need for a way to controllably use the naturally-occurring high-pressure gas already present downhole in one zone to provide gas lift for oil in another zone. An invention meeting this need may greatly increase the cost effectiveness of producing petroleum products using a gas-lift well.

Conventional packers are known such as described in U.S. Pat. Nos. 6,148,915, 6,123,148, 3,566,963 and 3,602,305.

All references cited herein are incorporated by reference to the maximum extent allowable by law. To the extent a reference may not be fully incorporated herein, it is incorporated by reference for background purposes, and indicative of the knowledge of one of ordinary skill in the art.

BRIEF SUMMARY OF THE INVENTION

The problems and needs outlined above are largely solved and met by the gas-lift well in accordance with the present invention. In accordance with one aspect of the present invention a gas-lift petroleum well for producing petroleum products using downhole pressurized gas, is provided. The gas-lift well comprises a well casing, a production tubing, a controllable packer, and a gas-lift valve. The well casing extends within a wellbore of the well, and the wellbore extends through oil and gas zones. The production tubing extends within the casing. The tubing comprises an opening formed therein, and the opening is in fluid communication with an oil zone. The controllable packer is coupled to the tubing and located downhole in the casing. The packer comprises an electrically controllable packer valve, which is adapted to control a flow of downhole pressurized gas from one side of the packer to another. The downhole pressurized gas is provided by a gas zone that the wellbore passes through. The downhole gas-lift valve is coupled to the tubing and is adapted to control a flow of downhole pressurized gas, which is also provided by the gas zone, into oil in the tubing. The gas-lift well can further comprise an induction choke located about the tubing proximate to the electrically controllable valve. The induction choke can be used to route electrical power and communications to the electrically controllable packer valve. The tubing and casing can be used as electrical conductors for supplying power and/or communications downhole. The current in the tubing is routed using a ferromagnetic induction choke to create a voltage potential downhole, which provides electrical power to downhole electrical devices. In addition, there may be a bypass passageway to route downhole gas to gas-lift valves. There may also be downhole sensors to measure physical quantities (e.g., pressure). Such measurements can be used for feedback control of downhole electrically controllable valves.

In accordance with another aspect of the present invention, a gas-lift petroleum well for producing petroleum products using downhole pressurized gas, is provided. The gas-lift well comprises a wellbore, a wellbore casing, a production tubing, two packers, an electrically controllable packer valve, a bypass passageway, and a gas-lift valve. The wellbore extends through subsurface oil and pressurized gas zones. The wellbore casing extends along and within the wellbore. The casing comprises a first perforated section located at an oil zone and a second perforated section located at a pressurized gas zone. The production tubing extends within the casing, and the tubing has an opening formed therein at the oil zone. The two packers are located in the casing. The electrically controllable packer valve is in one of the two packers. A first of the two packers is located above the first perforated casing section. A second of the two packers is located between the first and second perforated casing sections. A first space is formed between the tubing and the casing above the first packer. A second space is formed between the first and second packers within the casing. A third space is formed below the second packer within the casing. The bypass passageway fluidly connects the third space to the first space via the electrically controllable packer valve. Hence, the bypass passageway is adapted to provide a route for gas from the gas zone to travel from the third space to the first space without mixing with fluid in the second space. The gas-lift valve is located on a portion of the tubing at the first space, and the gas-lift valve is adapted to regulate fluid flow between the first space and an interior of the tubing.

Thus, using the present invention, the pressurized gas can flow from a naturally-occurring, downhole pressurized gas zone into the casing, then into the first space via the electrically controllable packer valve (which regulates and controls the gas flow into the first space), then into the tubing via the gas-lift valve (which regulates the gas flow into the tubing). The gas-lift valve can also be an electrically controllable valve.

In accordance with yet another aspect of the present invention, a method of producing petroleum products from a gas-lift well using downhole pressurized gas from a naturally-occurring subsurface pressurized gas zone is provided. The method comprises the steps of: allowing the downhole pressurized gas to flow from the gas zone into a well casing of the well; regulating flow of the downhole pressurized gas from within the casing into an interior of a production tubing using an electrically controllable downhole gas-lift valve, the tubing extending within the casing and the gas-lift valve being coupled to the tubing; allowing oil from a subsurface oil zone to enter the tubing; lifting the oil in the tubing using gas of the downhole pressurized gas from the downhole gas-lift valve; and producing petroleum products from the tubing at the surface.

In accordance with still another aspect of the present invention, a method of producing petroleum products using downhole pressurized gas is provided. The method comprises the following steps, in which the order of the steps may vary: (i) operably installing a wellbore casing in a wellbore, wherein the wellbore extends through subsurface oil and pressurized gas zones, the casing comprising a first section located at an oil zone of the zones and a second section located at a pressurized gas zone of the zones, with perforations formed in the casing after it is set such that formation fluids may enter the interior of the casing sections at both the oil and gas zones; (ii) operably installing a production tubing in the casing, the tubing having an opening formed therein at the oil zone; (iii) operably installing two packers in the casing, wherein one of the two packers comprises an electrically controllable packer valve, a first of the two packers is located above the first perforated casing section, and a second of the two packers is located between the first and second perforated casing sections, such that a first space is formed between the tubing and the casing above the first packer, a second space is formed between the first and second packers within the casing, and a third space is formed below the second packer within the casing; (iv) operably installing a bypass passageway between the two packers, such that the bypass passageway fluidly connects the third space to the first space via the electrically controllable packer valve, and the bypass passageway is adapted to provide a route for gas from the gas zone to travel from the third space to the first space without mixing with fluid in the second space; (v) operably installing a gas-lift valve on a portion of the tubing at the first space, such that the gas-lift valve is adapted to regulate fluid flow between the first space and an interior of the tubing; (vi) allowing gas to flow from the gas zone through the second perforated section into the third space; (vii) allowing gas to flow from the third space through the bypass passageway and through the electrically controlled packer valve into the first-space; (viii) allowing gas to flow from the first space through the gas-lift valve into the interior of the tubing; (ix) allowing oil to flow from the oil zone through the first perforated section into the second space; (x) allowing oil to flow from the second space through the tubing opening into the interior of the tubing; (xi) lifting oil in the tubing interior by decreasing the density of oil in the tubing interior with gas flowing from the gas-lift valve and entraining fluid flow due to a rising gas bubble stream from the gas-lift valve; and (xii) producing oil and gas from the tubing at the surface.

The present invention provides systems and methods to use reservoir gas for lifting oil from the oil bearing zones. The systems and methods of the present invention replace or supplement the use of compressed gas supplied by surface equipment. Such replacement or supplementing is likely much less costly and more environmentally desirable than merely supplying compressed gas with surface equipment.

The Related Applications describe alternative ways to provide electrical power from the surface to downhole devices, and to establish bi-directional communications for data and commands to be passed between the surface and downhole devices using surface and downhole modems. The preferred embodiment utilizes the production tubing and the well casing as the electrical conduction paths between the surface and downhole equipment. The cost reduction and simplification of installation procedures which accrue from obviating the need for electrical cables to provide power, sensing, and control functions downhole allow wider deployment of active equipment downhole during production.

The downhole devices may comprise individually addressable modems providing communications with the surface or with other downhole devices. The downhole devices may also comprise sensors or transducers for absolute pressure, pressure differentials, temperature, and/or flow rates, and such measurements may be communicated to the surface or used locally as the basis for control decisions. The downhole devices may further comprise control components such as electric-motor-operated valves or pressure regulators, the settings or set points of which can be altered by commands from the surface or commands generated locally in the downhole device.

In the present invention such downhole devices provide the necessary degree of real-time measurement and control to use downhole high-pressure gas sources for lift. That is, downhole sensors can monitor the operation of the well as the downhole gas sources are routed by controllable valves to lift the oil as needed or desired.

BRIEF DESCRIPTION OF THE DRAWINGS

Other objects and advantages of the invention will become apparent upon reading the following detailed description and upon referencing the accompanying drawings, in which:

FIG. 1 is a schematic, vertical section of a gas-lift petroleum production well incorporating an electrically controllable packer;

FIG. 2 is a simplified electrical schematic of the well system shown in FIG. 1;

DETAILED DESCRIPTION OF THE INVENTION

Figure 3:
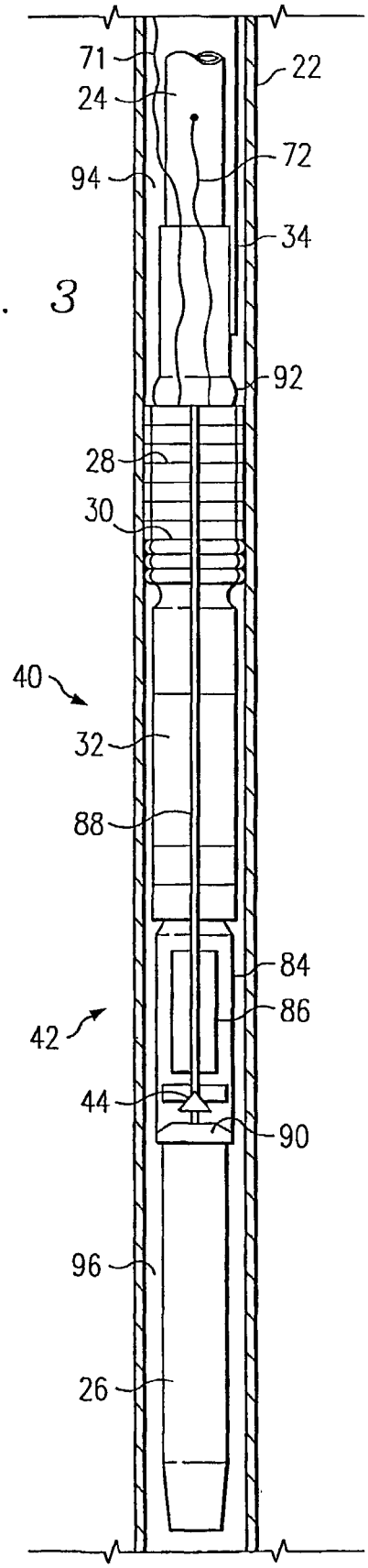
FIG. 3 is an enlarged schematic showing the controllable packer of FIG. 1.

Referring now to the drawings, wherein like reference numbers are used herein to designate like elements throughout the various views, preferred embodiments of the present invention are illustrated and further described, and other possible embodiments of the present invention are described. The figures are not necessarily drawn to scale, and in some instances the drawings have been exaggerated and/or simplified in places for illustrative purposes only. One of ordinary skill in the art will appreciate the many possible applications and variations of the present invention based on the following examples of possible embodiments of the present invention, as well as based on those embodiments illustrated and discussed in the Related Applications, which are incorporated by reference herein to the maximum extent allowed by law.

Note that the term "modem" is used herein to generically refer to any communications device for transmitting and/or receiving electrical communication signals via an electrical conductor (e.g., metal). Hence, the term "modem" as used herein is not limited to the acronym for a modulator (device that converts a voice or data signal into a form that can be transmitted)/demodulator (a device that recovers an original signal after it has modulated a high frequency carrier). Also, the term "modem" as used herein is not limited to conventional computer modems that convert digital signals to analog signals and vice versa (e.g., to send digital data signals over the analog Public Switched Telephone Network). For example, if a sensor outputs measurements in an analog format, then such measurements may only need to be modulated (e.g., spread spectrum modulation) and transmitted—hence no analog/digital conversion needed. As another example, a relay/slave modem or communication device may only need to identify, filter, amplify, and/or retransmit a signal received.

The term "valve" as used herein generally refers to any device that functions to regulate the flow of a fluid. Examples of valves include, but are not limited to, bellows-type gas-lift valves and controllable gas-lift valves, each of which may be used to regulate the flow of lift gas into a tubing string of a well. The internal workings of valves can vary greatly, and in the present application, it is not intended to limit the valves described to any particular configuration, so long as the valve functions to regulate flow. Some of the various types of flow regulating mechanisms include, but are not limited to, ball valve configurations, needle valve configurations, gate valve configurations, and cage valve configurations. The methods of installation for valves discussed in the present application can vary widely.

The term "electrically controllable valve" as used herein generally refers to a "valve" (as just described) that can be opened, closed, adjusted, altered, or throttled continuously in response to an electrical control signal (e.g., signal from a surface computer or from a downhole electronic controller module). The mechanism that actually moves the valve position can comprise, but is not limited to: an electric motor; an electric servo; an electric solenoid; an electric switch; a hydraulic actuator controlled by at least one electrical servo, electrical motor, electrical switch, electric solenoid, or combinations thereof; a pneumatic actuator controlled by at least one electrical servo, electrical motor, electrical switch, electric solenoid, or combinations thereof; or a spring biased device in combination with at least one electrical servo, electrical motor, electrical switch, electric solenoid, or combinations thereof. An "electrically controllable valve" may or may not include a position feedback sensor for providing a feedback signal corresponding to the actual position of the valve.

As used in the present application, "wireless" means the absence of a conventional, insulated wire conductor e.g. extending from a downhole device to the surface. Using the tubing and/or casing as a conductor is considered "wireless."

The term "sensor" as used herein refers to any device that detects, determines, monitors, records, or otherwise senses the absolute value of or a change in a physical quantity. A sensor as described herein can be used to measure physical quantities including, but not limited to: temperature, pressure (both absolute and differential), flow rate, seismic data, acoustic data, pH level, salinity levels, valve positions, or almost any other physical data.

Note that the terms "first location" and "second location" as used herein are each defined generally to call out a portion, section, or region of a piping structure that may or may not extend along the piping structure, that can be located at any chosen place along the piping structure, and that may or may not encompass the most proximate ends of the piping structure.

Similarly, in accordance with conventional terminology of oil field practice, the descriptors "upper", "lower", "uphole" and "downhole" are relative and refer to distance along hole depth from the surface, which in deviated or horizontal wells may or may not accord with vertical elevation measured with respect to a survey datum.

FIG. 1 illustrates generally the arrangement of upper and mid portions of a gas-lift petroleum well 38 incorporating an electrically controllable packer 40, an insulating tubing joint 46, and a ferromagnetic induction choke 48, for providing power and communications to the packer 40 in accordance with a preferred embodiment of the present invention. The petroleum production well 38 shown in FIG. 1 is similar to a conventional well in construction, but with the incorporation of the present invention. The packer 40 comprises an electrically powered device 42, and it is placed in the well 38 in the same manner as a conventional packer would be—to separate zones in a formation. In a preferred embodiment, the electrically powered device 42 of the packer 40 comprises an electrically controllable valve 44 that acts as a bypass valve.

FIG. 3 is an enlarged schematic showing the electrically controllable packer 40 of FIG. 1. Turning briefly to FIG. 3 to explain the placement of the packer 40 within a well casing 22, the packer 40 is threaded to a production tubing string 24. The packer 40 has a tail piece 26 that may terminate with an open or closed end, or the tail piece 26 may be threaded onto tubing (not shown in FIGS. 1 and 3) that passes to lower regions of the well 38. The packer 40 has a section of slips 28 and a seal section 30. Both the slips 28 and the seal section 30 can pass freely inside the well casing 22 during placement, and are operated by a hydraulic actuator 32. When the packer 40 is at its final location in the casing 22, the hydraulic actuator 32 is used to exert mechanical forces on the slips 28 and the seals 30 causing them to expand against the casing. The slips 28 lock the packer 40 in place by gripping the internal surface of the casing 22 so that the packer cannot be displaced by differential pressure between the spaces above and below the packer. The seal section 30 creates a liquid-tight seal between the spaces above and below the packer 40. The hydraulic actuator 32 is operated using high-pressure oil supplied from the surface (not shown) by a control tube 34.

Referring again to FIG. 1, the well casing 22 and the tubing string 24 act as electrical conductors for the system. The insulating tubing joint 46 and the induction choke 48 are incorporated into the system to route time-varying current through these conductors. The insulating tubing joint 46 is incorporated close to the wellhead to electrically insulate the lower sections of tubing 24 from casing 22. Thus, the insulating tubing joint 46 prevents an electrical short between the lower sections of tubing 24 and casing 22 at the tubing hanger 46. The hanger 64 provides mechanical coupling and support of the tubing 24 by transferring the weight load of the tubing 24 to the casing 22. The induction choke 48 is attached about the tubing string 24 at a second portion 52 downhole above the packer 40. A computer system 56 comprising a master modem 58 and a source of time-varying current 60 is electrically connected to the tubing string 24 below the insulating tubing joint 46 by a first source terminal 61. The first source terminal 61 is insulated from the hanger 64 where it passes through it. A second source terminal 62 is electrically connected to the well casing 22, either directly (as in FIG. 1) or via the hanger 64 (arrangement not shown). In alternative to or in addition to the insulating tubing joint 46, another induction choke (not shown) can be placed about the tubing 24 above the electrical connection location for the first source terminal 61 to the tubing.

The time-varying current source 60 provides the current, which carries power and communication signals downhole. The time-varying current is preferably alternating current (AC), but it can also be a varying direct current (DC). The communication signals can be generated by the master modem 58 and embedded within the current produced by the source 60. Preferably, the communication signal is a spread spectrum signal, but other forms of modulation can be used in alternative.

Referring still to FIG. 1, the electrically powered device 42 in the packer 40 comprises two device terminals 71, 72, and there can be other device terminals as needed for other embodiments or applications. A first device terminal 71 is electrically connected to the tubing 24 on a source-side 81 of the induction choke 48, which in this case is above the induction choke. Similarly, a second device terminal 72 is electrically connected to the tubing 24 on an electrical-return-side 82 of the induction choke 48, which in this case is below the induction choke. In this preferred embodiment, the slips 28 of the packer 40 provide the electrical connection between the tubing 24 and the well casing 22. However, as will be clear to one of ordinary skill in the art, the electrical connection between the tubing 24 and the well casing 22 can be accomplished in numerous ways, some of which can be seen in the Related Applications, including (but not limited to): another packer (conventional or controllable); conductive fluid in the annulus between the tubing and the well casing; a conductive centralizer; or any combination thereof. Hence, an electrical circuit is formed using the tubing 24 and the well casing 22 as conductors to the downhole device 42 within the packer 40.

FIG. 2 illustrates a simplified electrical schematic of the electrical circuit formed in the well 38 of FIG. 1. The insulating tubing joint 46 and the induction choke 48 effectively create an isolated section of the tubing string 24 to contain most of the time-varying current between them. Accordingly, a voltage potential develops between the isolated section of tubing 24 and the well casing 22 when AC flows through the tubing string. Likewise, the voltage potential also forms between tubing 24 on the source-side 81 of the induction choke 48 and the tubing 24 on the electrical-return-side 82 of the induction choke 48 when AC flows through the tubing string. In the preferred embodiment, the electrically powered device 42 in the packer 40 is electrically connected across the voltage potential between the source-side 81 and the electrical-return-side 82 of the tubing 24. However in alternative, the device 42 could be electrically connected across the voltage potential between the tubing 24 and the casing 22, or the voltage potential between the tubing 24 and part of the packer 40 (e.g., slips 28), if that part of the packer is electrically contacting the well casing 22. Thus, part of the current that travels through the tubing 24 and casing 22 is routed through the device 42 due to the induction choke 48.

In accordance with normal well construction practice, centralizers will be fitted to tubing 24 and 81 of FIG. 1, to maintain mechanical alignment between the tubing and the casing 22. The electrical equivalent circuit of FIG. 2 makes clear that all centralizers located on the tubing between isolation element 47 and choke 48 must be electrically insulating and disposed such that they do not create an electrical short circuit between tubing and casing. Suitable centralizers may be composed of solid molded or machined plastic, or be of the bow-spring type provided appropriate electrically insulating components are furnished to maintain electrical isolation between tubing and casing.

Other alternative ways to develop an electrical circuit using a piping structure and at least one induction choke are described in the Related Applications, many of which can be applied in conjunction with the present invention to provide power and/or communications to the electrically powered device 42 of the packer 40 and to form other embodiments of the present invention.

Turning again to FIG. 3, the controllable packer 40 is similar to the conventional packer, but with the addition of the electrically powered device 42 comprising the electrically controllable valve 44 and a communications and control module 84. The communications and control module 84 is powered from and communicates with the computer system 56 at the surface 54 via the tubing 24 and/or the casing 22. The communications and control module 84 may comprise a modem 86, a power transformer (not shown), a microprocessor (not shown), and/or other various electronic components (not shown) as needed for an embodiment. The communications and control module 84 receives electrical signals from the computer system 56 at the surface 54 and decodes commands for controlling the electrically controlled valve 44, which acts as a bypass valve. Using the decoded commands, the communications and control module 84 controls a low current electric motor that actuates the movement of the bypass valve 44. Thus, the valve 44 can be opened, closed, adjusted, altered, or throttled continuously by the computer system 56 from the surface 54 via the tubing 24 and well casing 22.

The bypass valve 44 of FIG. 3 controls flow through a bypass tube 88, which connects inlet and outlet ports 90, 92 at the bottom and top of the packer 40. The ports 90, 92 communicate freely with the annular spaces 94, 96 (between the casing 22 and the tubing 24), above and below the packer 40. The bypass control valve 44 therefore controls fluid exchange between these spaces 94, 96, and this exchange may be altered in real time using commands sent from the computer system 56 and received by the controllable packer 40.

The mechanical arrangement of the packer 40 depicted in FIG. 3 is illustrative, and alternative embodiments having other mechanical features providing the same functional needs of a packer (i.e., fluidly isolating and sealing one casing section from another casing section in a well, and in the case of a controllable packer, regulating and controlling fluid flow between these isolated casing sections) are possible and encompassed within the present invention. For example, the inlet and outlet ports 90, 92 may be exchanged to pass fluids from the annular space 94 above the packer 40 to the space 96 below the packer. Also, the communications and control module 84 and the bypass control valve 44 may be located in upper portion of the packer 40, above the slips 28. The controllable packer 40 may also comprise sensors (not shown) electrically connected to or within the communication and control module 84, to measure pressures or temperatures in the annuli 94, 96 or within the production tubing 24. Hence, the measurements can be transmitted to the computer system 56 at the surface 54 using the communications and control module 84, providing real time data on downhole conditions.

In other possible embodiments of the present invention, the electrically powered device 42 of the packer 40 may comprise: a modem 86; a sensor (not shown); a microprocessor (not shown); a packer valve 44; a tracer injection module (not shown); an electrically controllable gas-lift valve (e.g., for controlling the flow of gas from the annulus to inside the tubing) (not shown); a tubing valve (e.g., for varying the flow of a tubing section, such as an application having multiple branches or laterals) (not shown); a communications and control module 84; a logic circuit (not shown); a relay modem (not shown); other electronic components as needed (not shown); or any combination thereof.

Also in other possible embodiments of the present invention, there may be multiple controllable packers and/or multiple induction chokes. In an application where there are multiple controllable packers or additional conventional packers combined with the present invention, it may be necessary to electrically insulate some or all of the packers so that a packer does not act as a short between the tubing 24 and the casing 22 where such a short is not desired. Such electrical insulation of a packer may be achieved in various ways apparent to one of ordinary skill in the art, including (but not limited to): an insulating sleeve about the tubing at the packer location; a rubber or urethane portion at the radial extent of the packer slips; an insulating coating on the tubing at the packer location; forming the slips from non-electrically-conductive materials; other known insulating means; or any combination thereof.

Figure 4:
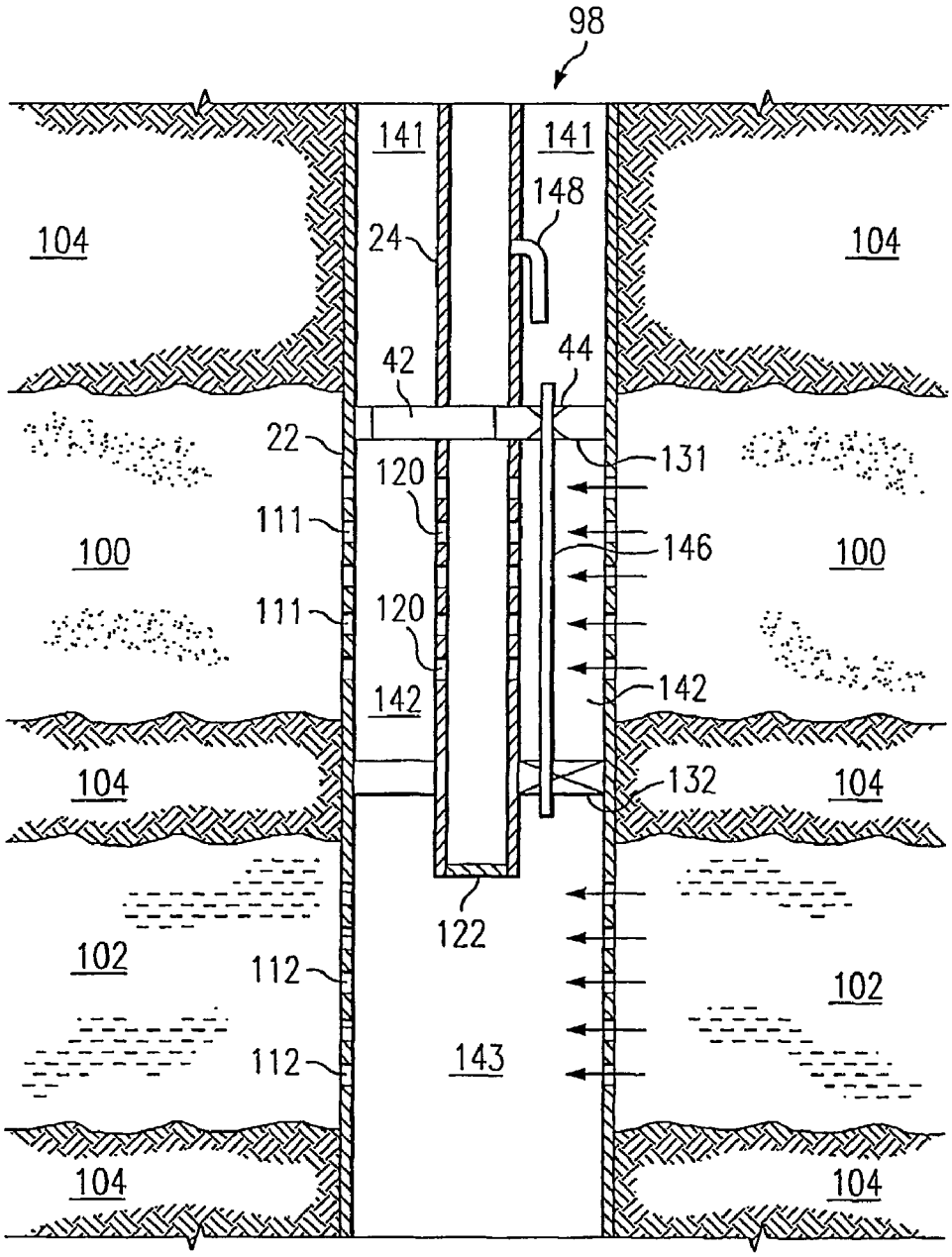
FIG. 4 is a schematic vertical section of an arrangement of gas-lift well equipment in. accordance with a preferred embodiment of the present invention.

FIG. 4 is a schematic showing a downhole portion of a gas-lift petroleum well 98 in accordance with a preferred embodiment of the present invention. In the example shown in FIG. 4, the well casing 22 extends within a wellbore that extends through a subsurface oil producing zone 100 and a subsurface pressurized gas zone 102 of a formation 104. FIG. 4 illustrates a case where a downhole high pressure gas zone 102 underlies an oil production zone 100. The other portions of the formation 104 may be non-producing zones or impermeable zones. The well casing 22 has a first perforated section 111 located at the oil zone 100. Also, the well casing 22 has a second perforated section 112 located at the pressurized gas zone 102. The production tubing 24 extends within the well casing 22. The tubing 24 has openings 120 formed therein at the oil zone 100. The tubing 24 has a closed end 122, but in another arrangement, the tubing could continue and extend to another oil zone or terminate at a different location.

In FIG. 4, a first packer 131 is located above the first perforated casing section 111. A second packer 132 is located between the first and second perforated casing sections 111, 112. Hence, the packers form three isolated spaces within the casing. A first space 141 is formed between the tubing 24 and the casing 22 above the first packer 131. A second space 142 is formed within the casing 22 between the first and second packers 131, 132, and a third space 143 is formed within the casing below the second packer. Although only a portion of the well 98 is shown in FIG. 4, there may be many more isolated spaces defined within the casing 22 by using more packers.

In FIG. 4, the first packer 131 is a controllable packer comprising an electrically controllable packer valve 44, such as the controllable packer 40 described above and shown in FIG. 3. The second packer 132 is a conventional dual-port packer known in the art. Hence, the oil zone 100 is isolated from the other parts of the well by the controllable packer 131 at the top of the oil production zone, and the conventional packer 132 at the bottom of the oil production zone. Although the first packer 131 in FIG. 4 is a controllable packer and the second packer 132 is conventional, one of ordinary skill in the art will realize that, in alternative, the second packer can be the controllable packer and the first packer can be conventional. Likewise, both packers 131, 132 can be controllable packers. Hence, there may be one or more electrically controllable packer valves 44 within one or both of the packers.

A bypass passageway 146 fluidly connects the third space 143 to the first space 141 via the electrically controllable packer valve 44. Hence, the bypass passageway 146 provides a route for gas from the pressurized gas zone 102 to travel from the third space 143 to the first space 141 without mixing with and bypassing oil from the oil zone 100 in the second space 142. The bypass passageway 146 of FIG. 4 comprises a tube connecting one port of the conventional packer 132 to the inlet of the electrically controllable packer valve 44 in the controllable packer 131.

In FIG. 4, the gas production zone 102 is isolated from the oil production zone 100 by permeable and impermeable layers in the formation 104, and by the conventional packer 132. During petroleum production operation of the well 98, perforations in the casing 22 at the first perforated section 111 permit the flow of oil into the second space 142. The perforations or openings 120 formed in the production tubing 24 permit the flow of oil from the second space 142 into the production tubing 24. Perforations in the casing 22 at the second perforated section 112 allow the passage of high-pressure gas from the gas zone 102 into the third space 143 within the casing below the second packer 132. The high-pressure gas from the third space 143 is conveyed through the bypass passageway 146 to the first space 141 above the first packer 131. This gas flow is regulated by the electrically controllable packer valve 44 in the controllable packer 131. A gas-lift valve 148 on a portion of the tubing 24 within the first space 141 permits the high-pressure gas (now within the first space 141) to enter the production tubing and thus lift oil up and out of the well 98. Alternatively, the high pressure gas may be directly coupled via passageway 146 to gas-lift valve 148. The gas-lift valve 148 may be conventional or controllable as described in the related applications. Therefore, oil and gas can be produced using naturally-occurring downhole pressurized gas to provide artificial lift for downhole oil. Hence, the conventional method of pumping pressurized gas into the first space 141 from the surface 54 can be either supplemented or completely replaced by the use of downhole pressurized gas from a gas zone 102 by use of the present invention.

The use of naturally-occurring formation gas can be controlled by the electrically controllable packer valve 44 in the controllable packer 131. The electrically controllable packer valve 44 can be opened, adjusted, closed, or continuously throttled by commands sent from the surface 54 to an electrically powered device 42 (e.g., a control and communications module 84 comprising a modem 86) of the controllable packer 131. In an enhanced form, a pressure transducer or sensor (not shown) can be further included in the controllable packer 131 to allow the pressure of the formation gas to be monitored continuously. This is desirable because the pressure of the formation gas is unregulated, in contrast with compressed gas supplied from the surface in existing practice. Hence, the combination of real-time measurement and control provided by the controllable packer 131 in accordance with the present invention allows for practical and controllable use of high-pressure formation gas for lift operations in the petroleum production well 98.

Figure 5:
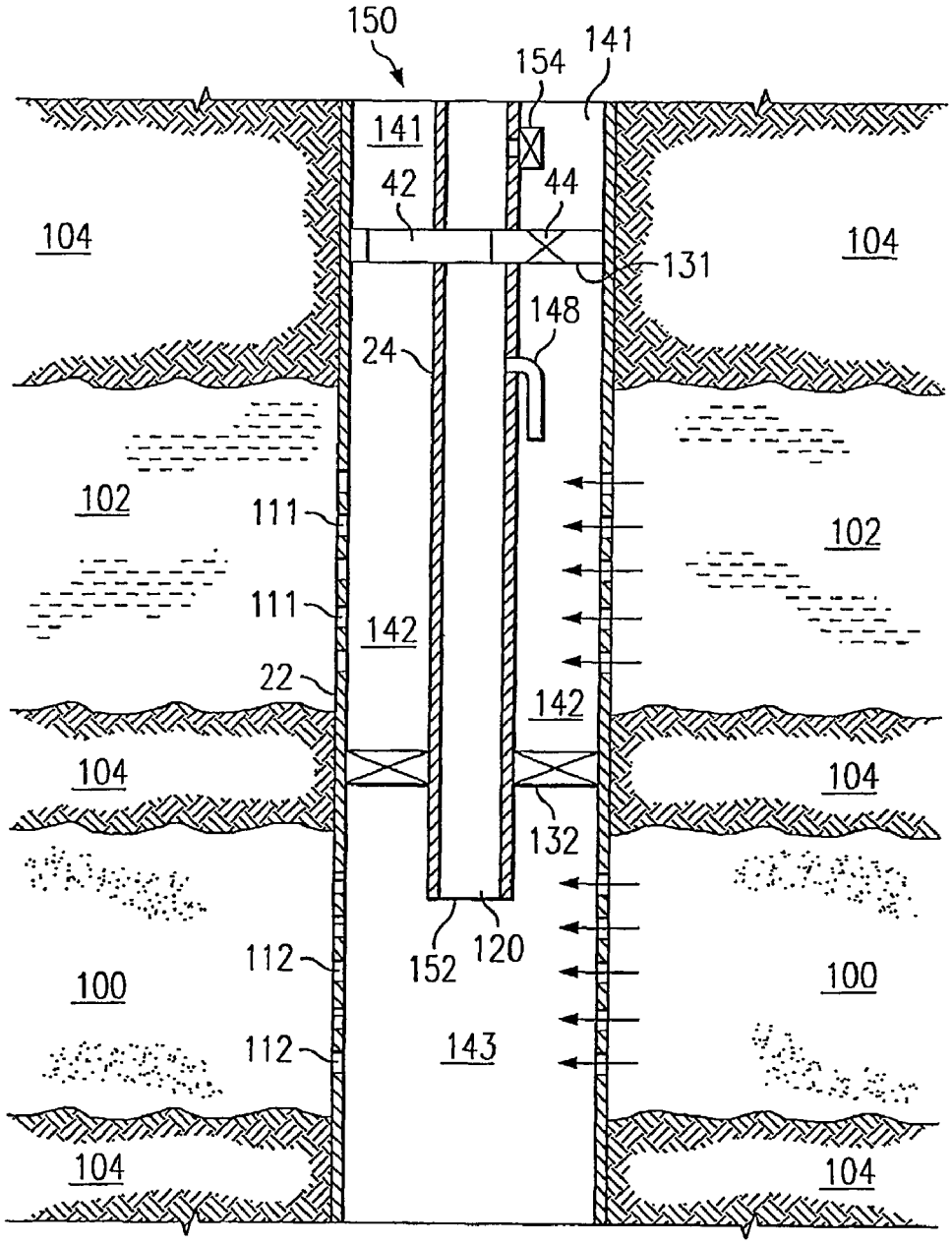
FIG. 5 is a schematic showing another arrangement of gas-lift well equipment in accordance with another preferred embodiment of the present invention.

FIG. 5 is a schematic showing a downhole portion of a gas-lift petroleum well 150 in accordance with another preferred embodiment of the present invention where the high pressure gas formation 102 is uphole relative to the oil production zone 100. Again, the well casing 22 extends within a wellbore that extends through a subsurface oil producing zone 100 and a subsurface pressurized gas zone 102. While FIG. 5 illustrates a vertical well where the downhole pressurized gas zone 102 lies above the oil production zone 100 it is understood that the present invention is applicable to highly deviated and horizontal wells. The embodiment in FIG. 5 does not have a bypass passageway 146 (as shown in the FIG. 4 embodiment). The casing 22 has a first perforated section 111 at the gas zone 102 and a second perforated section 112 at the oil zone 100. The tubing 24 terminates and has an open end 152 at the oil zone 100, but in other embodiments the tubing may extend further to other zones and have a perforated section in the tubing at the oil zone. Two packers 131, 132 are used to created isolated spaces. The first packer 131 is above the first perforated casing section 111. The first packer 131 is a controllable packer comprising an electrically controllable packer valve 44, such as the controllable packer 40 described above and shown in FIG. 3. The second packer 132 is located between the first and second perforated casing sections 111, 112 and it is a standard or conventional packer known in the art. Again different combinations of controllable and conventional packers can be used depending on the zones positions and characteristics, and desired well performances. Thus, a first space 141 is formed between the casing 22 and the tubing 24 above the first packer 131, a second space 142 is formed within the casing 22 between the packers 131, 132, and a third space 143 is formed below the second packer 132.

During petroleum production operation of the well 150, oil from the oil production zone 100 enters the third space 143 within the casing 22 through perforations at the second perforated casing section 112, and oil flows into the production tubing 24 through the opening 120 at its open end 152. The oil production zone 100 is isolated from the high-pressure gas zone 102 by formation layers 104, and by the standard production packer 132. The gas zone 102 and the second space 142 are isolated from the upper portion of the well (first space 141) by the controllable packer 131. Gas passes from the gas zone 102 into the second space annular 142 (between the casing 22 and the tubing 24) via the perforations at the first perforated casing section 111. A gas-lift valve 148 is coupled to the tubing 24 at the gas zone 102 (within the second space 142). The gas-lift valve 148 regulates the flow of high-pressure gas from the second space 142 into the production tubing 24 and thus lifting oil up the well 150 as gas injected into the tubing rises to the surface 54.

A gas-lift well typically has numerous gas-lift valves 148, 154 along the tubing 24. In operation the gas-lift well 150 can be unloaded or kicked off by surface-supplied compressed gas input into the tubing 24 through upper gas-lift kickoff valves 154, as in conventional practice. Typically after kick-off and during production, only the lowest gas-lift valve 148 is used to inject gas into the tubing 24. Using the present invention during production, the lift can be provided by gas from the high-pressure downhole gas zone 102 through the gas-lift valve 148 at the second space 142. In alternative, the electrically controllable packer valve 44 in the controllable packer can regulate and allow flow of gas from the downhole formation gas zone 102 into the first space 141 to supplement or replace the use of gas input from the surface 54. Again, a pressure sensor (not shown) can be incorporated into the controllable packer 131 to provide measurements of the gas pressure in the first space 141 and the second space 142. Such measurements can be used to know how much to regulate the gas flow into the first space 141 with the electrically controllable packer valve 44. Hence, naturally-occurring formation gas also can be controllably used during kick-off operations to supply high-pressure gas to the first space 141.

In a preferred embodiment the lowest gas-lift valve 148, which is typically most used during production, is an electrically controllable valve. Also, any of the other gas-lift valves 154, which are typically most used during kick-off, can also be electrically controllable valves. As also described in the Related Applications, an electrically controllable gas-lift valve can provide numerous advantages, as well as increases in production control, efficiency, and reliability. One or more controllable gas-lift valves can be used in conjunction with conventional gas-lift valves in varying embodiments of the present invention.

The present invention can be incorporated multiple times into a single petroleum well having multiple oil and gas production zones, or into a petroleum well have multiple laterals or horizontal branches extending therefrom. Hence, the tubing 24 may have multiple openings for oil input from multiple oil zones, and the casing 22 may have multiple perforated sections for multiple zones. Because the configuration of a well is dependent on the natural formation layout and locations of the oil and gas zones, the configuration and arrangement of an embodiment of the present invention may vary accordingly to suit the formation. Furthermore, a single space within the casing 22 needing high-pressurized gas can be supplied from multiple gas zones via multiple bypass passageways and controllable packers. In addition, there may be multiple induction chokes and/or transformers for routing current throughout a given piping structure and to provide power and/or communications to numerous electrically powered devices downhole (e.g., electrically controllable valves, sensors, modems). Also, there may be any combination and number of controllable packers mixed with conventional packers in a well, or there may be only controllable packers in a well.

The present invention allows both oil and gas to be produced from a single well simultaneously, and for the quantities of produced oil and gas to be independently controlled. In oil production using gas lift, there is a lower limit to the quantity of gas needed to maintain lift, but above this lower limit, any quantity of gas may be produced within the limits of the reservoir and the well. The ability to controllably produce both oil and gas from a single well greatly increases operational flexibility to accomodate requirements of downstream processes, and does so in an economically and ecologically desirable manner.

The present invention also can be applied to other types of wells (other than petroleum wells), such as a water well.

It will be appreciated by those skilled in the art having the benefit of this disclosure that this invention provides systems and methods for producing petroleum products from a gas-lift well using downhole formation gas to provide lift for downhole liquids (e.g., oil). It should be understood that the drawings and detailed description herein are to be regarded in an illustrative rather than a restrictive manner, and are not intended to limit the invention to the particular forms and examples disclosed. On the contrary, the invention includes any further modifications, changes, rearrangements, substitutions, alternatives, design choices, and embodiments apparent to those of ordinary skill in the art, without departing from the spirit and scope of this invention, as defined by the following claims. Thus, it is intended that the following claims be interpreted to embrace all such further modifications, changes, rearrangements, substitutions, alternatives, design choices, and embodiments.

The invention claimed is:

1. A gas-lift petroleum well for producing petroleum products using downhole pressurized gas, comprising:

a well casing extending within a wellbore of said well, said wellbore extending through an oil zone and at least one high pressure gas zone wherein the at least one high pressure gas zone is separate from the oil zone by at least one impermeable zone;

a downhole gas-lift valve coupled to a tubing and being adapted to control a flow of downhole pressurized gas into the tubing; and a connector for supplying gas from the gas zone to said down hole gas-lift valve bypassing said oil zone.

2. A gas-lift petroleum well in accordance with claim 1, wherein the connector for supplying gas from the gas zone to said down hole gas-lift valve comprises:

a controllable packer located downhole in said well casing and coupled to said tubing; and an electrically controllable packer valve, said electrically controllable packer valve being adapted to control a flow of down hole pressurized gas, provided by a gas zone, from one side of said packer to another.

3. A gas-lift petroleum well in accordance with claim 2, further comprising an induction choke located about said tubing proximate to said electrically controllable valve.

4. A gas-lift petroleum well in accordance with claim 1, wherein said gas-lift valve is electrically controllable, such that said gas-lift valve can be opened, closed, adjusted, or continuously throttled in response to an electrical signal.

5. A gas-lift petroleum well in accordance with claim 3, further comprising an induction choke located about said tubing proximate to said gas-lift valve.

6. A gas-lift petroleum well in accordance with claim 1, the well-casing extending along and within said wellbore, said well casing comprising a first perforated section located at an oil zone and a second perforated section located at a pressurized gas zone.

7. A gas-lift petroleum well in accordance with claim 1, further comprising a communications and control module.

8. A gas-lift petroleum well in accordance with claim 1, the tubing and well casing comprising well piping structure, including a source of time varying current applied to one of the piping structures in the well.

9. A gas-lift petroleum well in accordance with claim 1, further comprising a downhole modem adapted to send and receive communications along said tubing and well casing.

10. A gas-lift petroleum well in accordance with claim 1, further comprising plurality of packers to separate a plurality of oil zones from at least one gas zone.

11. A method of producing petroleum products from a gas-lift well using downhole pressurized gas from a subsurface pressurized gas zone, said method comprising the steps of:

supplying said downhole pressurized gas from said gas zone into a well casing of said well;

routing time-varying current to an electrically controllable gas-lift valve using an induction choke located downhole about a tubing;

regulating flow of said downhole pressurized gas from within said well casing into an interior of the tubing, said tubing extending within said well casing;

allowing oil from a subsurface oil zone to enter said tubing wherein the subsurface oil zone is separated from the pressurized gas zone by at least one impermeable zone;

lifting said oil in said tubing using at least in part gas bubbles of said downhole pressurized gas to lower the density of the mixture in said tubing; and producing petroleum products from said tubing at the surface;

further comprising the step of: regulating flow of said downhole pressurized gas between one space within said well casing and another space within said well casing with a controllable packer comprising an electrically controllable packer valve.

12. A method of operating a petroleum well comprising a wellbore traversing a gas producing formation and an oil production formation and a tubing comprising the steps of:

isolating the gas producing formation from the oil producing formation;

powering a downhole device operable to permit fluid communication between the formations, said power being supplied by an AC signal applied to the piping structure of the well;

routing gas from the gas producing formation to the interior of the tubing using said down hole device; and producing oil from the oil producing formation using the routed gas to aid in lifting the oil to the surface; wherein the downhole device comprising a packer having a controllable valve.

13. A method in accordance with claim 12, further comprising the steps of:

inputting a time-varying signal to the tubing of the piping structure;

routing part of said signal to the downhole device electrically connected to said tubing using an induction choke located about said tubing, wherein said downhole device comprises a gas-lift valve, said gas-lift valve being electrically controllable; and controlling said electrically controllable gas-lift valve based on said time-varying signal.

* * * * *